United States Patent [19]

McCloud

[11] Patent Number: 5,071,137

[45] Date of Patent: Dec. 10, 1991

[54] TABLE SOCCER GAME BUMPER STRUCTURE

[76] Inventor: Calvin E. McCloud, 4959 Rendon Rd., Fort Worth, Tex. 76140

[21] Appl. No.: 635,875

[22] Filed: Dec. 27, 1990

[51] Int. Cl.[5] ..... A63F 7/06

[52] U.S. Cl. ..... 273/85 D; 273/DIG. 10; 267/141

[58] Field of Search ..... 273/85 C, 85 D, DIG. 10; 384/909; 16/2, DIG. 33; 267/141, 145, 152, 292, 294; 248/632, 634, 635

[56] References Cited

U.S. PATENT DOCUMENTS

| | | | |
|---|---|---|---|
| 3,323,763 | 6/1967 | Butts | 267/153 X |
| 3,602,465 | 8/1971 | Velut | 267/153 X |
| 3,653,661 | 4/1972 | Leonhart | 273/85 D |
| 3,926,432 | 12/1975 | Furr et al. | 273/85 D |
| 4,078,797 | 3/1978 | Bergee | 273/85 D |
| 4,127,269 | 11/1978 | Rest | 273/85 D |
| 4,651,839 | 3/1987 | Isobe | 267/294 X |
| 4,925,163 | 5/1990 | Wolf et al. | 273/153 |

FOREIGN PATENT DOCUMENTS

| | | | |
|---|---|---|---|
| 0110233 | 6/1984 | European Pat. Off. | 267/141 |
| 50388 | 9/1966 | Fed. Rep. of Germany | 267/153 |
| 765266 | 6/1934 | France | 273/85 D |

*Primary Examiner*—Edward M. Coven
*Assistant Examiner*—Sebastiano Passaniti
*Attorney, Agent, or Firm*—Johnson & Gibbs

[57] ABSTRACT

An improved bumper for a fussball game table constructed with a plurality of apertures for improving the energy dissipation thereof. Each bumper is constructed of solid rubber in a generally cylindrical configuration having a central aperture formed therethrough for snugly receiving an actuation rod therein. The walls of the bumper include a plurality of apertures formed axially therethrough for removing mass therefrom. The apertures reduce the structural strength of the rubber bumper and increase its longitudinal compressibility to permit a harder, more reliable rubber to be utilized with sufficient energy absorptive characteristics for dissipating forces generated in the use of the actuation rods of the fussball game table.

13 Claims, 2 Drawing Sheets

TABLE SOCCER GAME BUMPER STRUCTURE

BACKGROUND OF THE INVENTION

1. Field of the Invention

The invention relates to table soccer or fussball game structures, and more particularly, to an improved bumper for positioning on an actuating rod adjacent a playing figure.

2. History of the Prior Art

The game of table soccer, also known as fussball, has developed into a very popular pastime in recent years. Players of the game have likewise advanced in the skill necessary for competitive play. These developments have led to a myriad of improvements in the game table structure. Such improvements are shown in several U.S. patents including U.S. Pat. Nos. 4,382,598 and 3,926,432. As set forth therein, both the game table construction and the playing figures themselves have been designed for better reliability, ball control and player enjoyment.

Fussball game tables typically include a rectangular, boxlike playing area supported on a plurality of legs at about waist height of a player. A plurality of axially slidable and rotatable actuating rods are mounted to extend transversely of the playing area. The actuating rods mount a plurality of playing figures which are arranged above the playing surface of the table in a preselected formation. A ball is placed in the playing surface and propelled by sharply rotating the actuating rods so that a foot of a playing figure strikes the ball and propels it along the playing surface toward one of the two goals located in opposite end walls.

In playing the game of table soccer, skilled players repeatedly manipulate the playing ball back and forth between adjacent ones of their playing figures to set up a clear path between the ball and their opponent's goal opening. Such manipulation includes passing the ball from one playing figure to another. A pass is affected through propelling the ball to one figure by striking it with the foot portion of a different figure. Another technique often used by players is that of manipulating a ball transversely with the rear foot portion of a figure and then suddenly circling the ball and shooting with the front of the foot portion. A ball passed from one figure to another is best caught with a receiving figure by first rotating the associated actuating rod to raise the foot portion to trap the ball between the foot portion and the playing surface of the table.

Such maneuvers also require the rapid axial movement of the actuating rods. The actuating rods are constructed to be shoved or pulled across the table playing surface at great speeds. This results in the playing figures, disposed on opposite ends of the rods, impacting upon the side walls of the table. The impact results in the need to dissipate considerable energy. It is for this reason that fiber washers are usually positioned on the outside of each playing figure and the reason that rubber bumpers are usually disposed outwardly of each outside playing figure on the actuation rod. The rubber bumpers are utilized to absorb the impact energy of the playing figure and rod assembly that rams into the side wall area. The bumpers must thus be able to absorb the impact energy and maintain their resilience while being exposed to the rough environment of a fussball game structure.

The environment of a fussball game structure includes smoke, beverages and various chemicals such as the lubricant conventionally utilized upon actuation rods for maintaining the lubricity thereof. It is necessary that the rods move both rotationally and axially with great ease, and considerable attention has been given to the design of fussball game tables to maintain the smoothness with which the rods move. The application of silicon and the debris and dirt picked up by the silicon is therefore deposited upon the bumpers disposed upon the rods. The material from which the bumpers are made must be able to withstand both the abrasive action as well as the chemical action from the silicon and other chemicals. Because many tables are placed in commercial establishments where beer and wine are sold and where routine table maintenance is at a minimum, it is necessary that the reliability of the rubber bumpers be maximized.

Problems associated with conventional bumpers are numerous. Chemical degradation can reduce the effectiveness of the bumper over prolonged use due to the high impact forces associated therewith. If a hard bumper material is utilized to accommodate the aspect of deterioration, the shock absorbing efficiency is usually greatly reduced. If a softer rubber bumper is utilized, it quickly deteriorates under the repeated pounding from the playing figures as well as the chemical deterioration and mechanical abrasion. It would be an advantage to provide the reliability and longevity of a hard rubber bumper with the flexibility of a soft rubber bumper in a single configuration that would provide maximum shock absorbing effectiveness and minimum use deterioration.

The present invention overcomes disadvantages of the prior art bumper designs by providing a bumper constructed of relatively hard rubber in a configuration affording improved shock absorption. A plurality of apertures are formed in the hard rubber bumper body to, within predefined limits, weaken the bumper structurally, thereby affording a higher degree of resilience and shock absorption while presenting a material capable of withstanding the mechanical and chemical environment of a fussball game table.

SUMMARY OF THE INVENTION

The present invention relates to table soccer or fussball game structures. More particularly, one aspect of the invention relates to an improved bumper for positioning outwardly adjacent an outermost playing figure on a table soccer actuation rod. The bumper is disposed upon the rod in a position to receive the impact forces from the adjacent playing figure through axial movement of the actuation rod into the side wall of the soccer table. The bumper is constructed with a series of apertures formed therein reducing the mass thereof and weakening the structure of the bumper. With a structurally weakened bumper, the impact forces from the playing figure and actuation rod are more readily accommodated by the compression of the bumper, which compression is facilitated by the apertures formed therein.

In a preferred embodiment thereof, the improved bumper of the present invention has a cylindrical configuration and is formed from a solid, relatively hard, molded rubber material, preferably having a hardness rating within the range of from about 35 durometer to about 45 durometer. A circularly cross-sectioned central passage is formed axially through the bumper and is radially sized to snugly receive a longitudinal portion of the actuating rod. Circumscribing the central bumper passage are a circumferentially spaced series of smaller diameter circularly cross-sectioned passages that axially extend through one end of the bumper to inwardly adjacent its opposite end which abuts the outermost playing figure. A metal washer is coaxially molded within such opposite end of the bumper and functions to limit its radially outward expansion, upon axial impact, thereby preventing it from riding up over the outermost playing figure side portion which it abuts.

The outer passages serve to structurally weaken the bumper in a manner increasing its longitudinal flexibility and shock absorbing capability. The improved bumper of the present invention is thus uniquely provided with the mechanical durability of hard rubber and the shock-absorbing capability of a much softer, but less durable material.

BRIEF DESCRIPTION OF THE DRAWINGS

For a more complete understanding of the present invention and for further objects and advantages thereof, reference may now be had to the following description taken in conjunction with the accompanying drawings in which.

DETAILED DESCRIPTION

Figure 1:
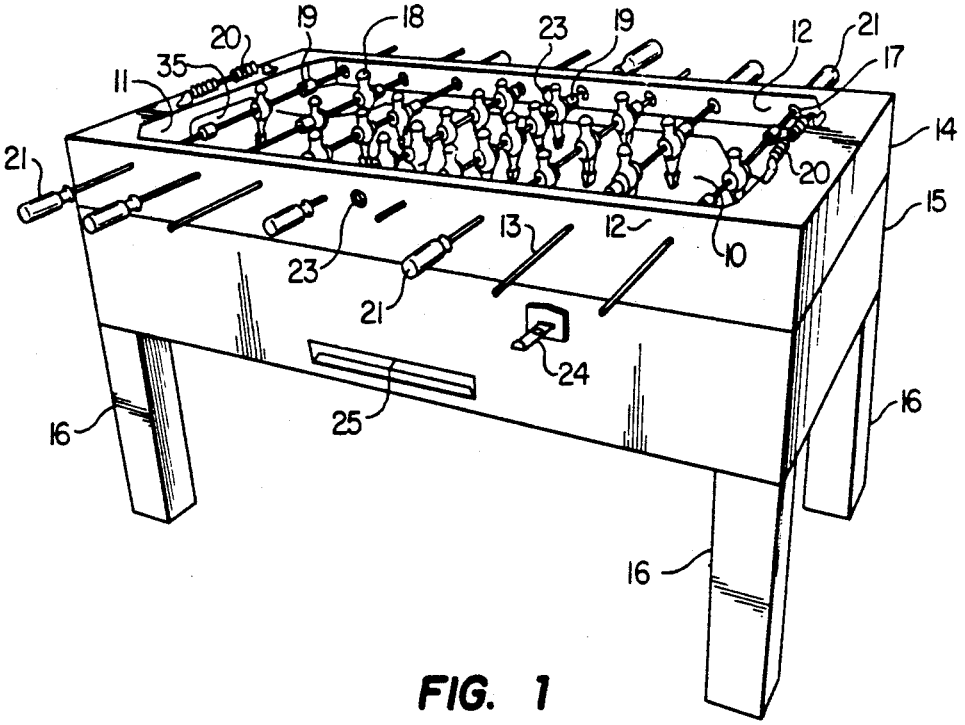
FIG. 1 is a perspective view of a fussball game table constructed in accordance with principles of the present invention.

As disclosed more fully in U.S. Pat. No. 3,926,432 issued Dec. 16, 1975 to Robert L. Furr and Robert I. Hayes, Jr., a fussball game table, as illustrated in FIG. 1, includes a playing surface 10, vertically extending end and side walls 11 and 12, respectively, and a plurality of transversely disposed playing figure actuation rods 13, rotatably mounted and axially slidable in opposite side walls 12. The playing surface 10 and the vertically extending end and side walls 11 and 12 comprise a top housing unit 14. The top unit 14 is hinged along the back edge to a lower housing unit 15 which is supported upon four vertically extending rectangular legs 16.

The actuating rods 13 are rotatably and slidably supported in a plurality of pairs of bearings 17 which are spaced along and in axial alignment with clearance apertures passing through the opposed longitudinal side walls 12. Each actuating rod 13 rigidly mounts one or more game figures 18. Soft, shook absorbing, cylindrical rubber bushings, or bumpers 19 are rigidly mounted to each of the actuating rods 13 and are located outside the outermost game figures 18 on each rod 13.

The rubber bumpers 19 serve as shock absorbers to prevent the outermost rod-mounted game figures 18 from striking too hard against the inner sides of the walls 12. This is particularly true during vigorous playing as the actuating rods 13 are quickly shifted axially in the bearings 17 to move the figures carried thereby relative to the playing surface 10. Each of the actuating rods 13 is fixed to a handle 21 at the playing end.

Figure 2:
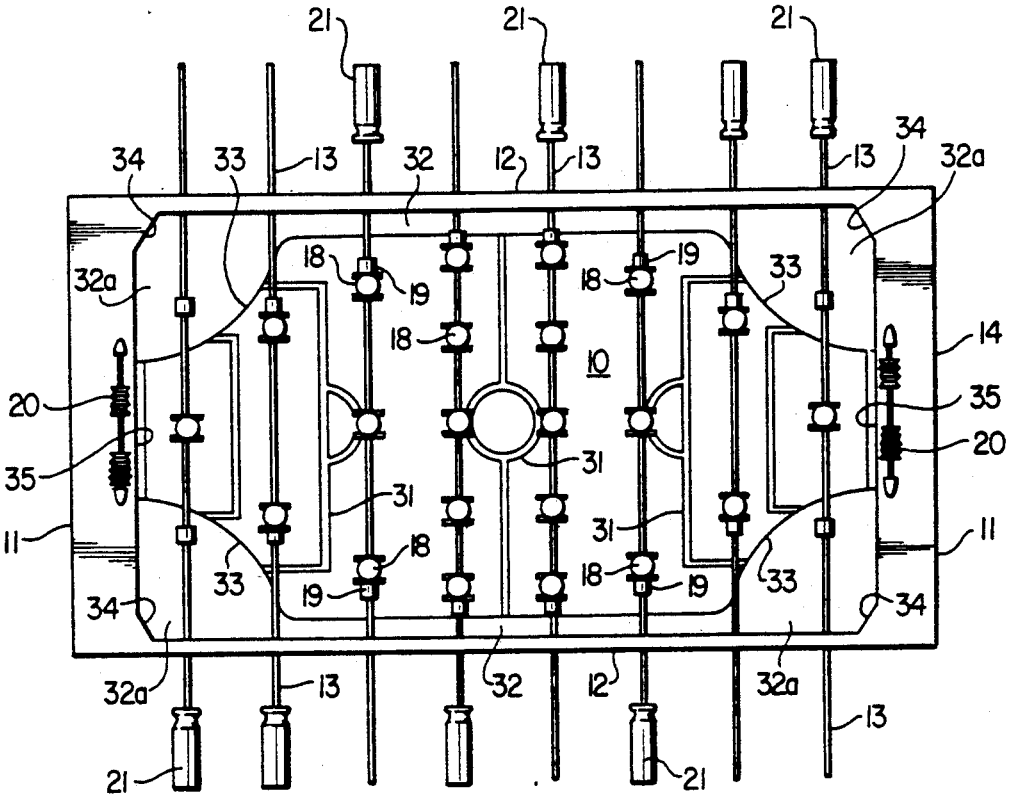
FIG. 2 is an enlarged scale top plan view of the fussball game table of FIG. 1 illustrating the actuation rods/playing figure/bumper construction associated therewith.

Referring now to FIG. 2, there is shown an enlarged scale top plan view of the fussball table of FIG. 1. The actual playing surface 10 overlies a printed soccer field configuration 31 which is supported by a solid undersurface. The outside edges of the playing area are lined by an inclined border 32 which extends from the walls 11 and 12. It may be seen that the rubber bumpers 19 are secured adjacent the outermost playing figures 18 in a position for facilitating direct engagement with the inner side $17_a$ of the bearing 17 (see FIG. 5). The function of the bumper 19 is, as stated above, to absorb the energy of the game FIG. 18 striking against the inner sides of the wall 12. For this reason, the resilience of the bumper 19 is a critical structural and functional aspect thereof.

Figure 3:
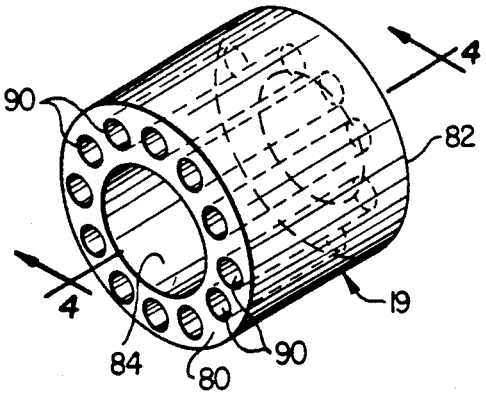
FIG. 3 is an enlarged scale perspective view of one of the bumpers of FIG. 2, illustrating in more detail the apertures formed therein.
Figure 4:
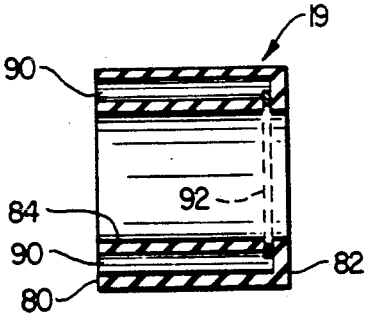
FIG. 4 is a cross-sectional view through the bumper taken along line 4—4 of FIG. 4.
Figure 5:
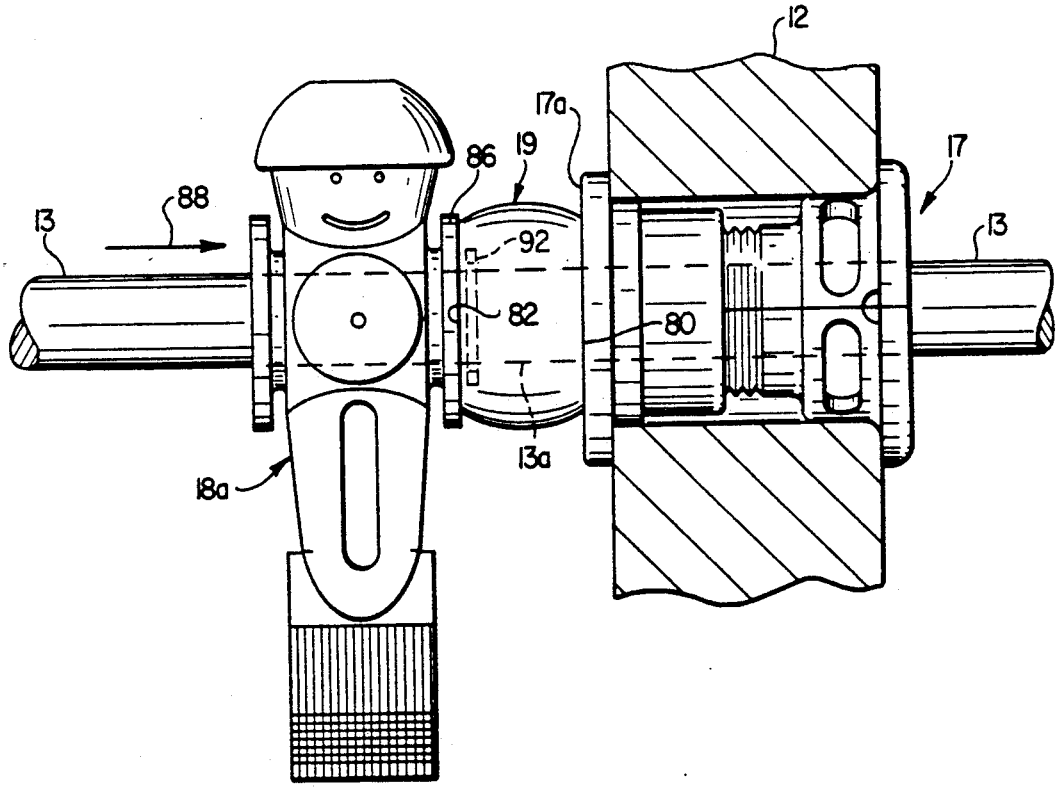
FIG. 5 is an enlarged side elevational view a portion of an actuation rod, playing figure and bumper assembly of FIG. 2 illustrating the cushioning action of the bumper in protecting a playing figure against side wall impact.

Referring now to FIGS. 3–5, the bumper 19 is of a hollow cylindrical configuration and is formed from a relatively hard solid rubber material, preferably in the 35 to 45 durometer hardness range. The bumper has a pair of annular opposite ends 80 and 82 defined by a circularly cross-sectioned central passage 84 extending axially through the bumper. The passage 84 is radially dimensioned to snugly receive a longitudinal portion $13_a$ of an actuating rod 13 (see FIG. 5) immediately adjacent an outer side flange 86 formed on the outermost playing FIG. $18_a$ shown in FIG. 5, with the bumper end 82 abutting flange 86.

When the rod 13 is axially moved rapidly to the right during play, as indicated by arrow 88, the bumper 19 prevents a rigid impact between flange 86 and the inner side portion $17_a$ of bearing 17. Instead, the end 80 of the bumper 19 forcibly strikes the bearing side portion $17_a$, causing the bumper to longitudinally compress and radially bulge as indicated in FIG. 5. The bumper thus resiliently "cushions" the side impact force on the outermost playing figure $18_a$ and protects it from impact damage.

The solid hard rubber used to form the bumper 19 is particularly advantageous, compared for example to the much softer cellular rubber typically used in bumpers of this sort, from the standpoints of mechanical durability and resistance to chemical degradation. However, solid rubber in the aforementioned 35–45 durometer hardness range is generally viewed as being too inflexible to resiliently absorb sufficient impact load to adequately protect the FIG. $18_a$ from wall impact forces typically arising during vigorous play. Stated in another manner, while the hardness of the solid rubber used to form bumper 19 is a durability attribute, such hardness would seemingly be a detriment in a resilient shock absorbing application such as that shown in FIG. 5.

Referring now to FIGS. 3 and 4, the present invention uniquely permits the use of relatively hard solid rubber in this shock absorbing application by forming in the body of the illustrated bumper 19 a circumferentially spaced series of circularly cross-sectioned apertures 90 (illustratively twelve in number) which are positioned radially outwardly of the central passage 84 and extend axially inwardly through the annular end 80 of the bumper body and terminate just short of the annular bumper end 82 as best illustrated in FIG. 4. The apertures 90 have diameters smaller than that of the central bumper passage 84 and serve to structurally weaken the bumper 19, in a manner desirably increasing its axial flexibility, without impairing its mechanical durability or its resistance to chemical degradation. The bumper 19 is thus provided with the dual attributes of mechanical toughness and "softened" shook absorbing resiliency.

As best illustrated in FIGS. 4 and 5, a metal washer 92 is integrally molded coaxially within the end 82 of the bumper 19. The washer 92 serves to limit the radially outward expansion of bumper end 82 upon impact, thereby preventing end 82 from expanding over the playing figure side flange 86 (FIG. 5).

Having described the invention in connection with certain and specific embodiments thereof, it is to be understood that further modifications may now suggest themselves to those skilled in the art and it is intended to cover such modifications as fall within the scope of the appended claims.

What is claimed is:

1. An improved bumper for a table soccer game structure of the type having a plurality of game figures mounted to rotationally and axially movable actuating rods mounted through side walls disposed about a playing field portion, certain ones of said playing figures disposed upon the actuating rod and having a resilient bumper disposed outwardly thereof, said bumper being positioned to absorb energy resulting from the axial movement of said rod and the impact of said playing figure and bumper against the side wall of the game structure, said improvement comprising said bumper having a cylindrical body having opposite first and second ends; a circularly cross-sectioned central passage extending axially through said body between said first and second ends and being radially sized to snugly receive a longitudinal portion of the actuating rod; and a circumferentially spaced series of apertures extending radially through said body radially outwardly of said central passage, said apertures extending inwardly through said first end of said body and terminating inwardly adjacent said second end thereof.

2. The improved bumper of claim 1 wherein said bumper includes at least ten of said apertures formed therein for increasing the compressibility thereof.

3. An improved bumper mountable on an actuating rod of a table soccer game between an upstanding side wall portion of the game and an outermost playing figure on the rod, said improved bumper being operative to absorb impact forces, axially directed relative to the rod, when said outermost playing figure is forcibly moved by the rod into adjacency with said side wall portion, said improved bumper comprising:

a cylindrical body formed from a rubber material and having opposite first and second ends;

a circularly cross-sectioned central passage extending axially through said cylindrical body and opening outwardly through said first and second ends thereof, said central passage being radially sized to snugly receive a longitudinal portion of the actuating rod; and aperture means formed in said cylindrical body and operative to structurally weaken it in a manner increasing its axial flexibility and shock absorbing capability in response to axial impact forces imposed thereon, said aperture means extending axially through said cylindrical body radially outwardly of said central passage and including a circumferentially spaced series of apertures extending axially through said cylindrical body radially outwardly of said central passage, said apertures extending inwardly through said first end of said cylindrical body and terminating inwardly adjacent said second end thereof, whereby said improved bumper is provided with the mechanical durability and chemical degradation resistance attributes of rubber, while at the same time having the enhanced shock absorbing capability of a softer but less durable resilient material.

4. The improved bumper of claim 3 wherein said rubber material has a hardness rating within the range of from about 35 durometer to about 45 durometer.

5. The improved bumper of claim 3 further comprising:

an annular washer member coaxially disposed within said second end of said cylindrical body and operative to limit the radially outward expansion thereof.

6. The improved bumper of claim 3 wherein:

said apertures, along their lengths, have circular cross-sections.

7. The improved bumper of claim 6 wherein:

the diameters of said apertures are smaller than the diameter of said central passage.

8. An improved bumper mountable on an actuating rod of a table soccer game between an upstanding side wall portion of the game and an outermost playing figure on the rod, said improved bumper being operative to absorb impact forces, axially directed relative to the rod, when said outermost playing figure is forcibly moved by the rod into adjacency with said side wall portion, said improved bumper comprising:

a body formed from a resilient material, said body extending along an axis and having opposite first and second ends spaced apart along said axis;

a circularly cross-sectioned central passage coaxially extending through said body and opening outwardly through said first and second ends thereof, said central passage being radially sized to snugly and coaxially receive a longitudinal portion of said actuating rod; and a circumferentially spaced series of apertures extending axially through said body radially outwardly of said central passage, said apertures extending inwardly through said first end of said body and terminating inwardly adjacent said second end thereof.

9. The improved bumper of claim 8 wherein:

said resilient material is a rubber material.

10. The improved bumper of claim 9 wherein:

said rubber material has a hardness rating within the range of from about 35 durometer to about 45 durometer.

11. The improved bumper of claim 8 further comprising:

an annular washer member coaxially disposed within said second end of said body and operative to limit the radially outward expansion thereof.

12. The improved bumper of claim 8 wherein:

said apertures, along their lengths, have circular cross-sections.

13. The improved bumper of claim 12 wherein:

the diameters of said apertures are smaller than the diameter of said central passage.

* * * * *